US010338506B2

(12) United States Patent
Yamamoto et al.

(10) Patent No.: US 10,338,506 B2
(45) Date of Patent: Jul. 2, 2019

(54) FIXING DEVICE

(71) Applicant: Konica Minolta, Inc., Chiyoda-ku, Tokyo (JP)

(72) Inventors: Koji Yamamoto, Toyokawa (JP); Mamoru Fukaya, Nagoya (JP); Toru Hayase, Toyohashi (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/139,504

(22) Filed: Apr. 27, 2016

(65) Prior Publication Data

US 2016/0349675 A1 Dec. 1, 2016

(30) Foreign Application Priority Data

May 29, 2015 (JP) ..... 2015-109264

(51) Int. Cl.
*G03G 15/20* (2006.01)

(52) U.S. Cl.
CPC ..... *G03G 15/205* (2013.01); *G03G 15/2017* (2013.01); *G03G 15/2042* (2013.01)

(58) Field of Classification Search
CPC ..... G03G 15/205; G03G 15/2017; G03G 15/2042
See application file for complete search history.

(56) References Cited

U.S. PATENT DOCUMENTS 8,718,502 B2 * 5/2014 Yuasa ..... G03G 15/2039 399/69
2002/0090233 A1 * 7/2002 Choi ..... G03G 15/11 399/251

(Continued)

FOREIGN PATENT DOCUMENTS

JP 53-029783 3/1978
JP 58-158672 9/1983

(Continued)

OTHER PUBLICATIONS

Office Action (Notice of Reasons for Rejection) dated May 2, 2017, by the Japanese Patent Office in corresponding Japanese Patent Application No. 2015-109264, and an English Translation of the Office Action. (20 pages).

(Continued)

*Primary Examiner* — David M. Gray
*Assistant Examiner* — Michael A Harrison
(74) *Attorney, Agent, or Firm* — Buchanan Ingersoll & Rooney PC

(57) ABSTRACT

A fixing device includes: a fixing rotator; a pressure rotator configured to be pressed into contact with the fixing rotator to form a nip portion; a heating section configured to be provided over an outer circumference of the fixing rotator in a non-contact manner with the fixing rotator and heat the fixing rotator; and a power shutdown section configured to shut down power supply to the heating section when temperature becomes higher than a predetermined setting temperature, wherein the heating section includes an infrared heater and a reflection member which covers the infrared heater and whose portion facing the fixing rotator is an opening portion, a longitudinal length of the reflection member is longer than a length in an axis direction of a light emitting unit of the infrared heater, and a temperature detection unit of the power shutdown section is arranged outside the reflection member.

15 Claims, 9 Drawing Sheets

(56) References Cited

U.S. PATENT DOCUMENTS

| | | | | |
|---|---|---|---|---|
| 2011/0150544 | A1 | 6/2011 | Ishida et al. | |
| 2014/0376980 | A1* | 12/2014 | McDavid | G03G 15/2007 399/334 |

FOREIGN PATENT DOCUMENTS

| | | | | |
|---|---|---|---|---|
| JP | 59-022474 | A | | 2/1984 |
| JP | 60-135755 | U | | 9/1985 |
| JP | 08-016030 | A | | 1/1996 |
| JP | 11-030929 | A | | 2/1999 |
| JP | 2000-121950 | A | | 4/2000 |
| JP | 2002-72757 | A | | 3/2002 |
| JP | 2002072757 | A | * | 3/2002 |
| JP | 2006-172781 | A | | 6/2006 |
| JP | 2007-328222 | A | | 12/2007 |
| JP | 2011-113015 | A | | 6/2011 |
| JP | 2013-020107 | A | | 1/2013 |
| JP | 2014-044091 | A | | 3/2014 |
| JP | 2014-066850 | A | | 4/2014 |
| JP | 2015-075736 | A | | 4/2015 |

OTHER PUBLICATIONS

Office Action (Notice of Reasons for Rejection) dated Oct. 10, 2017, by the Japanese Patent Office in corresponding Japanese Patent Application No. 2015-109264, and an English Translation of the Office Action. (21 pages).

Office Action (Decision of Rejection) dated Feb. 28, 2018, by the Japanese Patent Office in corresponding Japanese Patent Application No. 2015-109264, and an English Translation of the Office Action. (14 pages).

* cited by examiner

FIXING DEVICE

The entire disclosure of Japanese Patent Application No. 2015-109264 filed on May 29, 2015 including description, claims, drawings, and abstract are incorporated herein by reference in its entirety.

BACKGROUND OF THE INVENTION

Field of the Invention

The present invention relates to a fixing device, and more specifically to an external heating type fixing device including an infrared heater.

Description of the Related Art

In a fixing device used in an electrophotographic image forming device, in an internal heating method where an infrared heater is arranged inside a fixing roller, an inner circumferential surface of the fixing roller is heated first and the heat is gradually transferred to a surface of the fixing roller, so that the temperature of the surface of the fixing roller rises slowly and a warm-up time tends to be long. On the other hand, in an external heating method where an infrared heater is arranged outside a fixing roller, a surface of the fixing roller is directly heated, so that the temperature of the surface of the fixing roller rises fast and the warm-up time is reduced.

Here, when a so-called thermal runaway occurs in which the infrared heater is continuously turned on, an entire external circumferential surface of the fixing roller is equally heated in the internal heating method, so that when a temperature detected by a temperature sensor arranged on the surface of the fixing roller exceeds a predetermined temperature, a power supply to the infrared heater is shut down and the fixing roller is prevented from fuming and firing. On the other hand, in the external heating method, in a state in which the fixing roller is stopped, only an area where infrared rays are irradiated from the infrared heater is intensively heated and a temperature detection area where infrared rays are not irradiated is not heated directly, so that in a configuration in which the temperature of the surface of the fixing roller is detected, there is a risk that the power supply to the infrared heater is not shut down even when the thermal runaway occurs.

JP 2002-72757 A discloses an external heating type fixing device which includes a heat conducting member that receives heat from a heating source and transfers the heat to a fixing roller by being in contact with the fixing roller, a temperature detecting means that detects a temperature of the heat conducting member, and a temperature control means that controls a heating temperature of the heating source, and in which the temperature control means shuts down power supply to the heating source when the temperature detecting means detects a temperature higher than a predetermined setting temperature.

In the fixing device disclosed in JP 2002-72757 A, it is possible to quickly shut down the power supply to the heating source against the thermal runaway of the heating source when the fixing roller is stopped. However, regarding the thermal runaway of the heating source when the fixing roller is rotated, the temperature at a contact portion between the heat conducting member and the fixing roller is hard to rise, so that there is a risk that it takes time for the power supply to the heating source to be shut down or the power supply is not shut down.

Further, in the fixing device disclosed in JP 2002-72757 A, there is a risk that a temperature detection sensitivity is degraded even when the contact portion of the heat conducting member is slightly separated from the fixing roller because of, for example, deformation of the contact portion of the heat conducting member during paper jam.

SUMMARY OF THE INVENTION

The present invention has been made in view of the above conventional problems, and an object thereof is to quickly shut down power supply to a heating section and prevent a fixing rotator from fuming and firing when the heating section thermally runs away while the fixing rotator is stopped or rotated.

Another object of the present invention is not to cause a member to be deformed during paper jam and not to cause a surface of the fixing rotator to be scarred.

To achieve at least one of the abovementioned objects, according to an aspect, a fixing device reflecting one aspect of the present invention comprises: a fixing rotator; a pressure rotator configured to be pressed into contact with the fixing rotator to form a nip portion; a heating section configured to be provided over an outer circumference of the fixing rotator in a non-contact manner with the fixing rotator and heat the fixing rotator; and a power shutdown section configured to shut down power supply to the heating section when temperature becomes higher than a predetermined setting temperature, wherein the heating section includes an infrared heater and a reflection member which covers the infrared heater and whose portion facing the fixing rotator is an opening portion, a longitudinal length of the reflection member is longer than a length in an axis direction of a light emitting unit of the infrared heater, and a temperature detection unit of the power shutdown section is arranged outside the reflection member.

According to the above configuration, the reflection member preferably has a planer portion and the temperature detection unit is preferably arranged in contact with the planer portion.

According to the above configuration, the temperature detection unit is preferably arranged vertically above the infrared heater.

According to the above configuration, an area of an inside surface of the reflection member, which faces the temperature detection unit, is preferably processed to have an emissivity higher than that of the other area of the inside surface.

According to the above configuration, a thickness of an area of the reflection member, which faces the temperature detection unit, is preferably thinner than the other area of the reflection member.

According to the above configuration, a shape of an outside surface area of the reflection member, which faces the temperature detection unit, is preferably a recessed shape, and an inside surface area opposite to the outside surface area preferably forms the same surface as that of the other area.

According to the above configuration, a through hole is preferably formed in an area of the reflection member, which faces the temperature detection unit.

According to the above configuration, a size of the through hole is preferably smaller than the temperature detection unit and light from the infrared heater does not preferably leak to outside from the reflection member through the through hole.

According to the above configuration, when the reflection member becomes an overheated state by the infrared heater, the reflection member preferably deforms so that the temperature detection unit comes close to the infrared heater.

According to the above configuration, a plurality of infrared heaters are preferably provided so that light distributions in the longitudinal direction are complementary to each other according to a paper width, and the temperature detection unit is preferably provided at a position corresponding to a boundary portion where the light distributions of the plurality of infrared heaters are overlapped.

According to the above configuration, a plurality of infrared heaters are preferably provided so that light distributions in the longitudinal direction are complementary to each other according to a paper width, and the temperature detection unit is preferably provided at a position, distances from which to each infrared heater are substantially the same.

According to the above configuration, the temperature detection unit is preferably movable to a temperature detection position where temperature can be detected and a retreat position where temperature cannot be detected, and the temperature detection unit is preferably located at the retreat position while information indicating that a sheet of paper is being transported is being acquired.

According to the above configuration, the fixing device preferably further comprises a control section configured to control movement of the temperature detection unit, and the control section preferably outputs a signal for moving the temperature detection unit from the temperature detection position to the retreat position after a predetermined period of time elapses after an image forming instruction signal is input and outputs a signal for moving the temperature detection unit from the retreat position to the temperature detection position after a predetermined period of time elapses after an image forming end signal is input.

According to the above configuration, the fixing device preferably further comprises a heat insulating section configured to be located between the temperature detection unit and the reflection member and be able to move to a heat blocking position where the heat insulating section blocks heat from the reflection member to the temperature detection unit and a retreat position retreated from between the temperature detection unit and the reflection member, and the heat insulating section is preferably located at the heat blocking position while information indicating that a sheet of paper is being transported is being acquired.

According to the above configuration, the fixing device preferably further comprises an air blowing section configured to flow air through a contact portion or a gap portion between the temperature detection unit and the reflection member, and the air blowing section preferably flows air through the contact portion or the gap portion between the temperature detection unit and the reflection member while information indicating that a sheet of paper is being transported is being acquired.

According to the above configuration, a first setting temperature and a second setting temperature higher than the first setting temperature are preferably provided as setting temperatures at which the power supply to the heating section is shut down, the first setting temperature is preferably used when no sheet of paper is transported, and the second setting temperature is preferably used while a sheet of paper is being transported.

To achieve at least one of the abovementioned objects, according to an aspect, an image forming device reflecting one aspect of the present invention comprises any one of the fixing devices.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of a fixing device and an image forming device of the present invention will be described with reference to the drawings. However, the scope of the invention is not limited to the illustrated examples.

Figure 1:
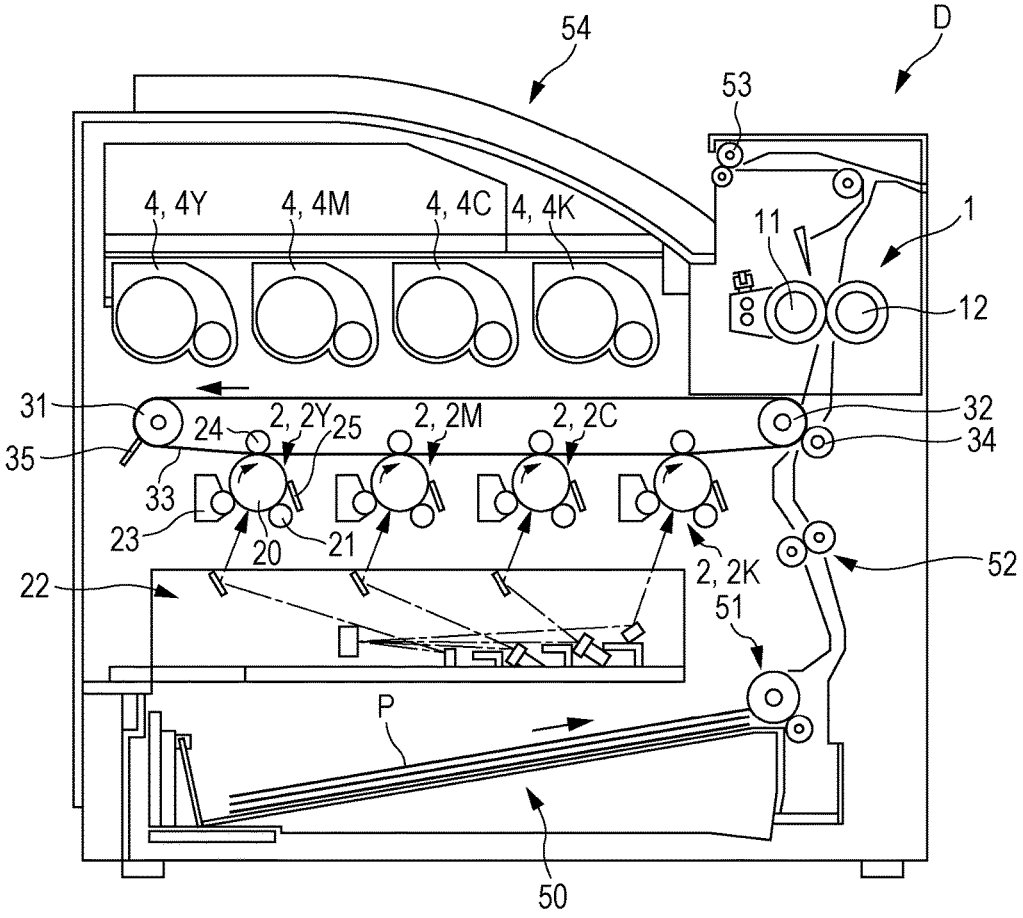
FIG. 1 is a schematic diagram showing an embodiment of an image forming device according to the present invention.

FIG. 1 is a schematic diagram showing an embodiment of the image forming device and the fixing device of the present invention. The image forming device D in FIG. 1 is a color printer of a so-called tandem method. Of course, the present invention can be applied not only to a printer, but also to a copy machine including a scanner, a facsimile, and a complex machine that complexly includes functions of printer, copy machine, and facsimile. An image forming method is not limited to the tandem method, but may be other methods, such as, for example, a four-cycle method that creates a full-color image by arranging four developing devices around an axis of rotation and causing the developing devices to sequentially face an electrostatic latent image carrier or a monochrome method that creates a monochrome image by using one developing device.

The image forming device D includes an endless intermediate transfer belt 33 having conductivity. The intermediate transfer belt 33 is suspended between a pair of rollers 31 and 32 arranged left and right, respectively, in FIG. 1. The roller 32 is connected to a motor not shown in FIG. 1 and rotated counterclockwise by being driven by the motor. Thereby, the intermediate transfer belt 33 and the roller 31 in contact with the intermediate transfer belt 33 are driven and rotated. A secondary transfer belt 34 is pressed into contact with outside of a belt portion supported by the roller 32. A toner image formed on the intermediate transfer belt 33 is transferred to a sheet of paper P being transported in a nip portion (a secondary transfer area) between the secondary transfer belt 34 and the intermediate transfer belt 33.

A cleaning member 35 that cleans a surface of the intermediate transfer belt 33 is provided to the outside of a belt portion supported by the roller 31. The cleaning member 35 is pressed into contact with the roller 31 through the intermediate transfer belt 33. The cleaning member 35 collects untransferred toner at the contact portion.

Four image creation units 2Y, 2M, 2C, and 2K of yellow (Y), magenta (M), cyan (C), and black (K) (hereinafter may be collectively referred to as an "image creation unit 2") are arranged below the intermediate transfer belt 33 suspended between the roller 31 and the roller 32 in order from the upstream side of the rotation direction of the intermediate transfer belt 33. In each image creation unit 2, a toner image of a corresponding color is created by using developer of each color.

The image creation unit 2 includes a cylindrical photoreceptor 20 as an electrostatic latent image carrier. Around the photoreceptor 20, a charging unit 21, a developing device 23, a primary transfer roller 24, and a photoreceptor cleaning member 25 are arranged around the photoreceptor 20 along a rotation direction (clockwise direction) of the photoreceptor 20. The primary transfer roller 24 is pressed into contact with the photoreceptor 20 with the intermediate transfer belt 33 in between to form a nip portion (primary transfer area). An exposure device 22 is arranged below the image creation unit 2.

In the embodiment shown in FIG. 1, the charging unit 21 of a roller charging method is used. However, the type of the charging unit 21 is not particularly limited, and of course it is possible to use an electrostatic charger of a corona discharge method, a blade-shaped charging member, a brush-shaped charging member, and the like. In the embodiment, a plate-shaped blade is used as the photoreceptor cleaning member 25 and the toner remaining on the surface of the photoreceptor 20 is collected and removed by causing one end of the plate-shaped blade to be in contact with the outer circumferential surface of the photoreceptor 20. However, the photoreceptor cleaning member 25 is not limited to a plate-shaped blade, and it is possible to use, for example, a fixed brush, a rotary brush, a roller, and a combination of a plurality of these members. The photoreceptor cleaning member 25 is not necessarily required to be provided, and it is possible to employ a cleanerless method in which the untransferred toner on the photoreceptor 20 is collected by the developing device 23.

Hoppers 4Y, 4M, 4C, and 4K (hereinafter may be collectively referred to as a "hopper 4"), which contain toner to be supplied to the developing device 23 of each color, are provided above the intermediate transfer belt 33. A paper feed cassette 50 used as a paper feed device is attachably and detachably arranged below the exposure device 22. The sheets of paper P stacked inside the paper feed cassette 50 are sent out to a transport path one by one in order from the uppermost sheet of paper by rotation of a paper feed roller 51 arranged near the paper feed cassette 50. The sheet of paper P sent out from the paper feed cassette 50 is transported to a resist roller pair 52 and then sent out from here to the secondary transfer area at a predetermined timing.

The image forming device D can be switched to a monochrome mode in which a monochrome image is formed by using single color toner (for example, black) and a color mode in which a color image is formed by using four-color toner.

An example of an image forming operation in the color mode will be briefly described. First, in each image creation unit 2, the outer circumferential surface of the photoreceptor 20 driven to rotate at a predetermined circumferential speed is charged by the charging unit 21. Next, light according to image information is projected from the exposure device 22 to the charged surface of the photoreceptor 20 and an electrostatic latent image is formed. Subsequently, the electrostatic latent image is actualized by toner that is developer supplied from the developing device 23. When toner images of each color formed on the surface of the photoreceptor 20 reach the primary transfer area by the rotation of the photoreceptor 20, the toner images are transferred (primary-transferred) from the photoreceptor 20 to the intermediate transfer belt 33 and superimposed in the order of yellow, magenta, cyan, and black.

The untransferred toner that is not transferred to the intermediate transfer belt 33 and remains on the photoreceptor 20 is scraped off by the photoreceptor cleaning member 25 and removed from the outer circumference surface of the photoreceptor 20.

The superimposed four-color toner image is transported to the secondary transfer area by the intermediate transfer belt 33. On the other hand, at the above timing, the sheet of paper P is transported from the resist roller pair 52 to the secondary transfer area. Then, the four-color toner image is transferred (secondary-transferred) from the intermediate transfer belt 33 to the sheet of paper P in the secondary transfer area. The sheet of paper P to which the four-color toner image is transferred is transported to a fixing device 1. In the fixing device 1, the sheet of paper P passes through a nip portion between a fixing roller (fixing rotator) 11 and a pressure roller (pressure rotator) 12. During this time, the sheet of paper P is heated and pressed, and the toner image on the sheet of paper P is fused and fixed to the sheet of paper P. The specific configuration of the fixing device 1 will be described later. The sheet of paper P to which the toner image is fixed is discharged to a paper discharge tray 54 by a discharge roller pair 53.

On the other hand, the intermediate transfer belt 33 that has passed through the secondary transfer area is cleaned by the cleaning member 35. Thereafter, the rotations of each photoreceptor 20 and the intermediate transfer belt 33 are stopped.

(First Embodiment)

Figure 2:
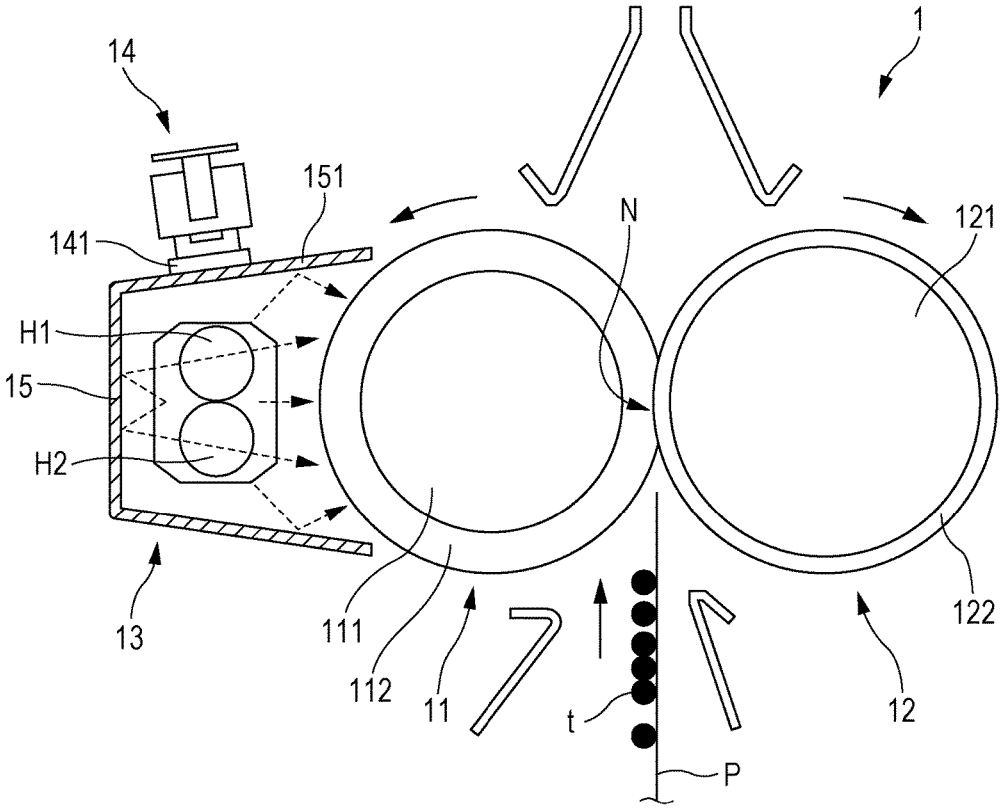
FIG. 2 is a schematic diagram of a fixing device mounted in the image forming device in FIG. 1.

FIG. 2 is a schematic configuration diagram of the fixing device 1 mounted in the image forming device D in FIG. 1. The fixing device 1 includes the fixing roller 11 and the pressure roller 12 that is pressed into contact with the fixing roller 11. The fixing roller 11 is rotated in the counterclockwise direction by a motor (not shown in FIG. 2), which is a rotation drive section, and thereby the pressure roller 12 is driven to rotate. It is possible that the motor is not provided to the fixing roller 11, but is provided to the pressure roller 12 and the fixing roller 11 is driven to rotate.

The fixing roller 11 includes a core metal 111 formed into a columnar shape and an elastic layer 112 laminated on the external circumference of the core metal 111. A metal material such as free-cutting steel (SUM22) is preferable as a material of the core metal 111. Examples of the elastic layer 112 include silicone rubber and fluoro-rubber. As one form of such a fixing roller 11, a fixing roller where a rubber layer with a thickness of 3 mm is provided on the surface of a core metal formed of a free-cutting steel with a diameter of 19 mm is exemplified. Further, the surface of the elastic layer 112 may be covered with a tube formed of a fluorine-based material such as PFA, PTFE, and ETFE, or a coating layer may be formed of the above fluorine-based material as a surface layer.

The pressure roller 12 includes a columnar core metal 121 and an elastic layer 122 laminated on the external circumference of the core metal 121. A surface layer formed of a fluorine-based material is further provided on the surface of the elastic layer 122. Preferable forms of the core metal 121, the elastic layer 122, and the surface layer are the same as those of the fixing roller 11. As one form of such a pressure roller 12, a pressure roller where a rubber layer with a thickness of 1 mm is provided on the surface of a core metal formed of a free-cutting steel with a diameter of 25 mm is exemplified. A pressure-contact force applied from the pressure roller 12 to the fixing roller 11 is normally about several hundred N (for example, 300 N).

A heating section 13 is provided over the outer circumference of the fixing roller 11 in a non-contact manner with the fixing roller 11. The heating section 13 includes two rod-shaped infrared heaters H1 and H2 provided in a vertical direction in parallel with a rotation axis of the fixing roller 11 and a reflection member 15 which covers the two infrared heaters H1 and H2 separately from the two infrared heaters H1 and H2 and has an opening portion facing the fixing roller 11 and whose length in the longitudinal direction is longer than the length of light emitting units of the infrared heaters H1 and H2 in the longitudinal direction. A thermostat (power shutdown section) 14 is provided vertically above the infrared heaters H1 and H2 and outside the reflection member 15. The thermostat 14 comprises a temperature detection unit 141 and a power shutdown unit which are integrally formed together. Although the thermostat 14 is used as a power shutdown section in each embodiment described below, the power shutdown section that can be used in the present invention is not limited to the thermostat 14 and of course the temperature detection unit 141 and the power shutdown unit may be formed separately from each other.

The reflection member 15 is formed of a metal material such as aluminum and stainless steel. The inner circumferential surface of the reflection member 15 is a mirror surface so that the infrared rays emitted from the infrared heaters H1 and H2 are reflected. The inside surface of the reflection member 15 has a shape for causing the reflected infrared rays to be concentrated into a predetermined heating area of the surface of the fixing roller 11.

The infrared rays emitted from the infrared heaters H1 and H2 (dashed line arrows in FIG. 2) are irradiated to the surface of the fixing roller 11 directly from the infrared heaters H1 and H2 or by being reflected by the inside surface of the reflection member 15 and heat the surface of the surface of the fixing roller 11.

In the fixing device 1 having such a configuration, the transported sheet of paper P passes through a nip portion N formed by the fixing roller 11 and the pressure roller 12 so that a surface on which an unfixed toner image t is placed faces the fixing roller 11. While the sheet of paper P is passing through a nip portion N, the toner image t is heated and pressed, so that the toner image t is fused and fixed to the sheet of paper P. Thereafter, the sheet of paper P is discharged to the paper discharge tray 54 (shown in FIG. 1).

Here, when the infrared heaters H1 and H2 thermally run away, a conventional fixing device detects an abnormal temperature rise by a temperature sensor that detects a surface temperature of the fixing roller 11 and shuts down power supply to the infrared heaters H1 and H2. Therefore, it is possible to relatively quickly cope with the thermal runaway of the infrared heaters H1 and H2 while the fixing roller 11 is rotating. However, when the infrared heaters H1 and H2 thermally runs away when the fixing roller 11 stops, it takes time for the temperature of the detection area to rise because the detection area of the temperature sensor is away from the heating area of the infrared heaters H1 and H2, so that there is a risk that it takes time for the power supply to the infrared heaters H1 and H2 to be shut down or the power supply is not shut down.

On the other hand, in the present invention, the temperature detection unit 141 of the thermostat 14 is provided on the outside of the reflection member 15, so that it is possible to quickly detect not only the thermal runaway of the infrared heaters H1 and H2 while the fixing roller 11 is rotating, but also the thermal runaway of the infrared heaters H1 and H2 when the fixing roller 11 stops. Therefore, it is possible to quickly shut down the power supply to the infrared heaters H1 and H2.

The first embodiment shown in FIG. 2 uses the thermostat 14 in which the temperature detection unit 141 and the power shutdown unit which are integrally formed together as the power shutdown section. The temperature detection unit 141 of the thermostat 14 is arranged vertically above the infrared heaters H1 and H2 and on a planar-shaped upper plate 151 of the reflection member 15. In this way, the temperature detection unit 141 is arranged outside the reflection member 15, so that it is possible to quickly detect the thermal runaway of the infrared heaters H1 and H2 regardless of the presence or absence of the rotation of the fixing roller 11. In addition, the arrangement position of the temperature detection unit 141 is vertically above the infrared heaters H1 and H2, so that a heat flow which is heated by the infrared heaters H1 and H2 and becomes an ascending air current comes into contact with the upper plate 151 of the reflection member 15. Therefore, it is possible to more quickly detect the thermal runaway of the infrared heaters H1 and H2.

In the fixing device 1 shown in FIGS. 1 and 2, the heating section 13 is provided laterally to the fixing roller 11. However, the attachment position of the heating section 13 is not limited as long as the attachment position is located at the outer circumference of the fixing roller 11 and the attachment position may be determined from the transport direction of the sheet of paper, limitations of the device configuration, and the like.

(Second Embodiment)

Figure 3:
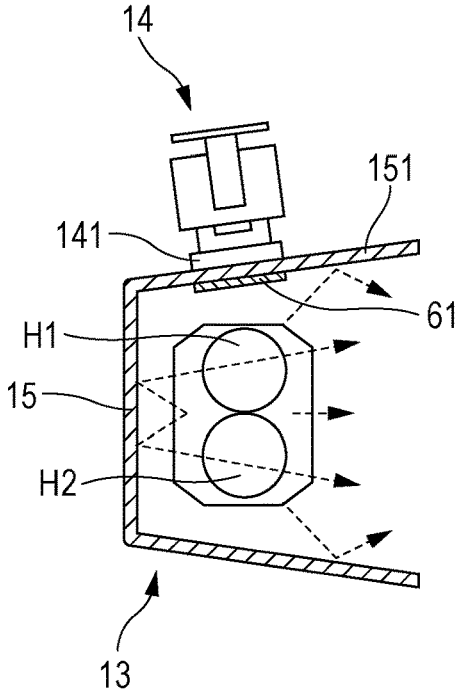
FIG. 3 is a schematic diagram showing a second embodiment of the fixing device according to the present invention.

FIG. 3 shows a second embodiment of the fixing device according to the present invention. The fixing roller 11 and the pressure roller 12 are the same as those of the first embodiment, so that the description thereof will be omitted and components different from those of the first embodiment will be described.

In the reflection member 15 of the heating section 13 shown in FIG. 3, a black coating portion 61 is provided in an area of an inside surface of the upper plate 151 facing the temperature detection unit 141 of the thermostat 14 so that the thermal emissivity of the area is higher than the other area of the inside surface. The infrared rays irradiated from the infrared heaters H1 and H2 are reflected by the inside surface of the reflection member 15 other than the black coating portion 61. However, the infrared rays irradiated from the infrared heaters H1 and H2 are absorbed by the black coating portion 61. Thereby, it is possible to more quickly detect the thermal runaway of the infrared heaters H1 and H2 by using the temperature detection unit 141. As a means for increasing the thermal emissivity, in addition to the black coating, a conventionally known means such as increasing the surface roughness can be employed.

(Third Embodiment)

Figure 4:
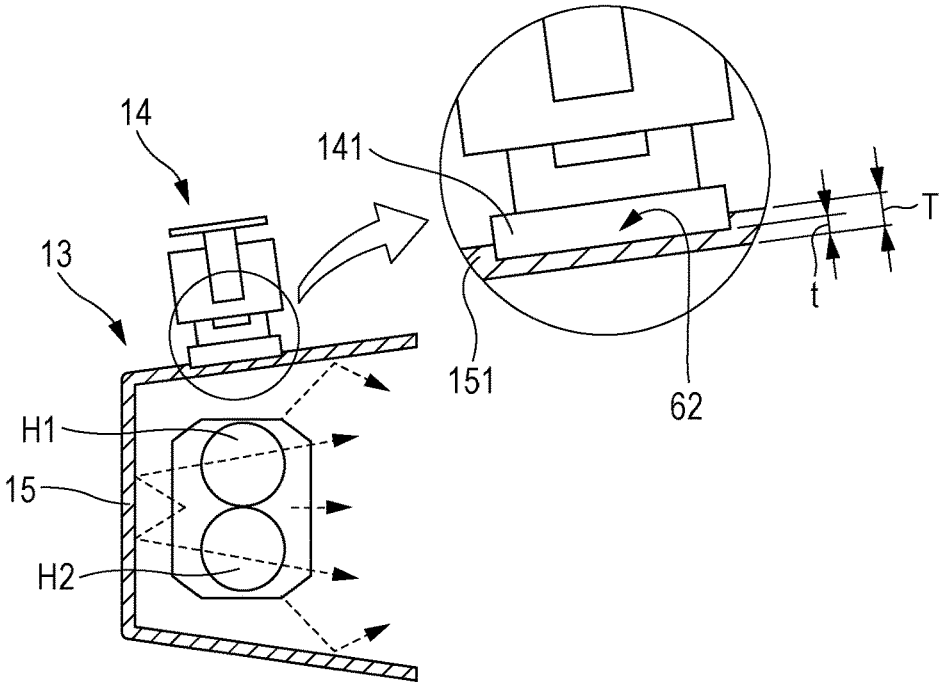
FIG. 4 is a schematic diagram showing a third embodiment of the fixing device according to the present invention.

FIG. 4 shows a third embodiment of the fixing device according to the present invention. The fixing roller 11 and the pressure roller 12 are the same as those of the first embodiment, so that the description thereof will be omitted and components different from those of the first embodiment will be described.

A certain degree of plate thickness is required for the reflection member 15 so as to secure a predetermined rigidity and so as not to cause deformation due to deflection during heating. However, the thicker the plate thickness of the reflection member 15, the slower the temperature of the reflection member 15 rises. Therefore, in the reflection member 15 of the heating section 13 shown in FIG. 4, a recessed portion 62 is formed on the outside surface of the upper plate 151 in an area facing the temperature detection unit 141 of the thermostat 14 and the inside surface of the upper plate 151 is the same as that of the other area. The temperature detection unit 141 of the thermostat 14 is fitted into the recessed portion 62. In this way, the thickness of the temperature detection portion of the reflection member 15 is reduced, so that a detection sensitivity of the temperature detection unit 141 is increased by increasing the temperature rise speed and, at the same time, a predetermined rigidity of the reflection member 15 is held. The inside surface of the upper plate 151 where the recessed portion 62 is formed forms the same surface as that of the other area, so that a reflection state of the infrared rays does not vary and reflection unevenness does not occur.

For example, the plate thickness T of the reflection member 15 (shown in an enlarged view indicated by a circle in FIG. 4) is in a range of 0.5 mm to 1 mm, the thickness t of the recessed portion 62 to which the temperature detection unit 141 is attached can be reduced to about 0.2 mm. Although the temperature detection unit 141 of the thermostat 14 is fitted into the recessed portion 62 in the present embodiment, the temperature detection unit 141 may be arranged to be separated from the recessed portion 62 and to face the recessed portion 62. However, from a viewpoint of increasing the sensitivity of detecting the rise of temperature, it is preferable that the temperature detection unit 141 is attached inside the recessed portion 62.

(Fourth Embodiment)

Figure 5:
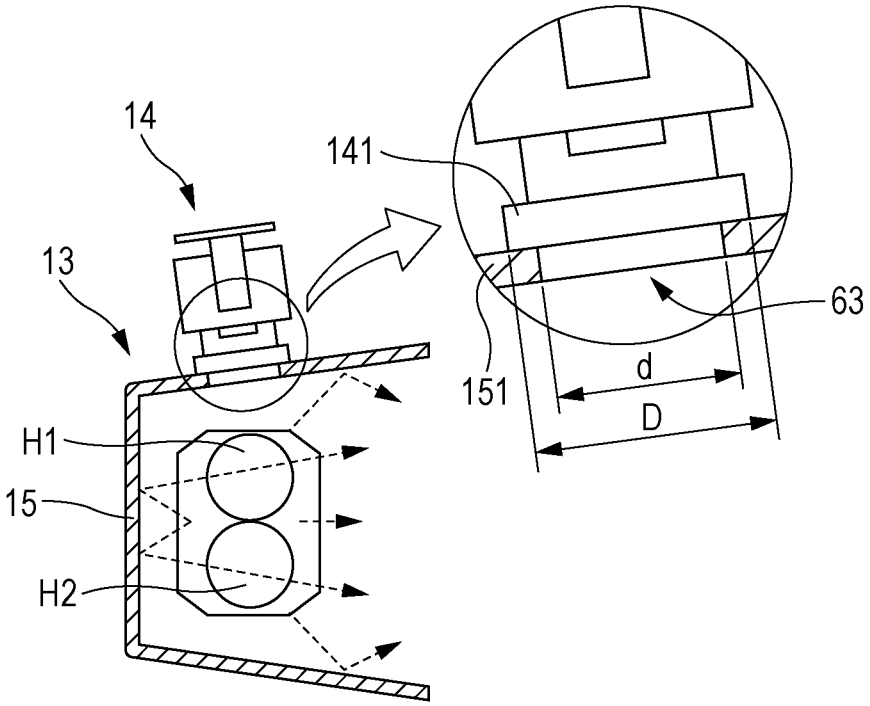
FIG. 5 is a schematic diagram showing a fourth embodiment of the fixing device according to the present invention.

FIG. 5 shows a fourth embodiment of the fixing device according to the present invention. The fixing roller 11 and the pressure roller 12 are the same as those of the first embodiment, so that the description thereof will be omitted and components different from those of the first embodiment will be described.

In the reflection member 15 of the heating section 13 shown in FIG. 5, a through hole 63 is formed in an area which is included in the upper plate 151 and which faces the temperature detection unit 141 of the thermostat 14. The size d of the through hole 63 (shown in an enlarged view indicated by a circle in FIG. 5) is smaller than the size D of the temperature detection unit 141 (shown in the enlarged view indicated by a circle in FIG. 5), and the thermostat 14 is attached to the upper plate 151 so that the thermostat 14 completely closes the through hole 63. Thereby, the infrared rays emitted from the infrared heaters H1 and H2 are directly irradiated to the temperature detection unit 141 of the thermostat 14, so that the temperature detection sensitivity of the temperature detection unit 141 is improved. Further, the temperature detection unit 141 completely closes the through hole 63, so that the infrared rays from the infrared heaters H1 and H2 do not leak to the outside from the reflection member 15. Although a processing accuracy is required, the temperature detection unit 141 of the thermostat 14 and the through hole 63 may have the same planer shape and the temperature detection unit 141 may be completely fitted into the through hole 63 so that the infrared rays do not leak to the outside.

(Fifth Embodiment)

Figure 6B:
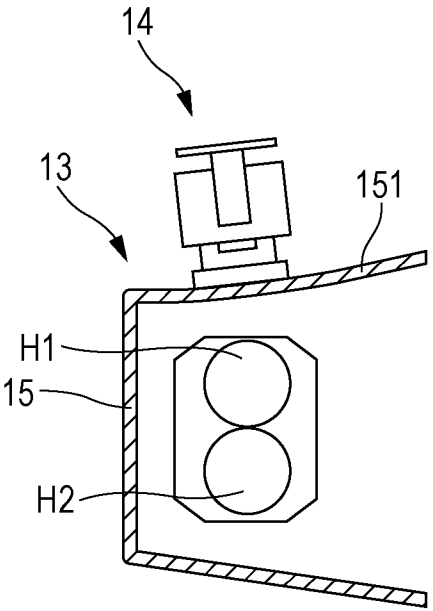
FIGS. 6A and 6B are schematic diagrams showing a fifth embodiment of the fixing device according to the present invention.
Figure 6A:
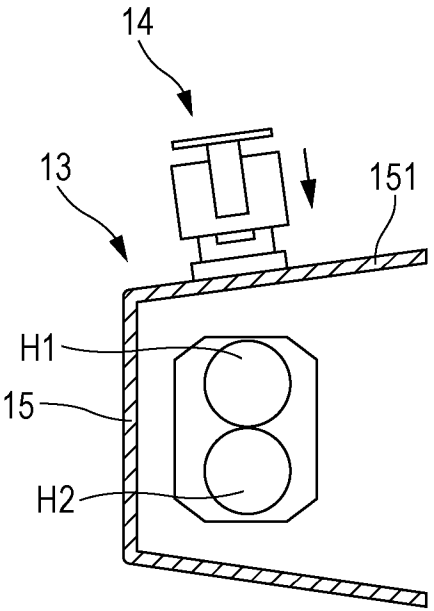

FIGS. 6A and 6B show a fifth embodiment of the fixing device according to the present invention. The fixing roller 11 and the pressure roller 12 are the same as those of the first embodiment, so that the description thereof will be omitted and components different from those of the first embodiment will be described.

In the fixing device shown in FIGS. 6A and 6B, the rigidity of the upper plate 151 of the reflection member 15 to which the thermostat 14 is attached varies according to the temperature. Specifically, in the case of normal heating (for example, 200° C. or lower), the upper plate 151 of the reflection member 15 has enough rigidity with respect to the weight of the thermostat 14, so that the upper plate 151 is not deformed (FIG. 6A). On the other hand, when an overheating state occurs (for example, 400° C. or higher), the rigidity of the upper plate 151 is reduced and the upper plate 151 sags toward the infrared heaters due to the weight of the thermostat 14 (FIG. 6B). As a result, the temperature detection unit 141 comes close to the infrared heaters H1 and H2, so that the temperature detection sensitivity increases. On the other hand, when the power supply to the infrared heaters H1 and H2 is shut down and the temperature of the upper plate 151 lowers, the rigidity of the upper plate 151 is restored, the upper plate 151 is restored to the original state against the weight of the thermostat 14, and the temperature detection unit 141 returns to the original position away from the infrared heaters H1 and H2.

In the embodiment shown in FIGS. 6A and 6B, the thermostat 14 is provided vertically above the infrared heaters H1 and H2, so that the weight of the thermostat 14 is used as a pressure to the upper plate 151 toward the infrared heaters. However, the upper plate 151 may be urged toward the infrared heaters by further using an urging section such as a spring. When the thermostat 14 is not arranged above the infrared heaters, an urging section such as a spring is required to deform the reflection member 15 toward the infrared heaters.

(Sixth Embodiment)

Figure 7A:
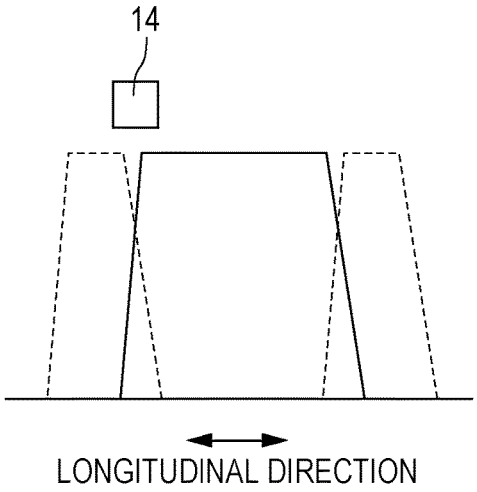
FIGS. 7A and 7B are schematic diagrams showing a sixth embodiment of the fixing device according to the present invention.
Figure 7B:
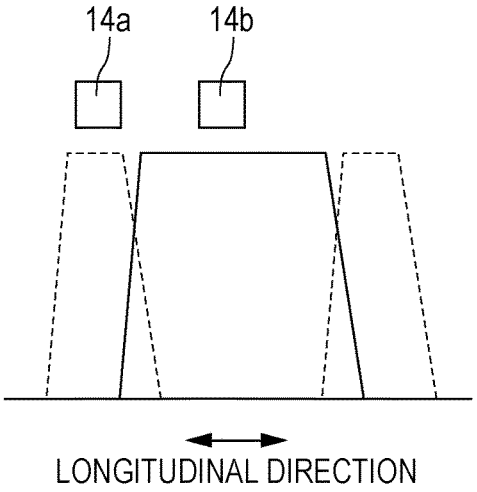

FIGS. 7A and 7B show a light distribution diagram of the infrared heaters H1 and H2. In FIGS. 7A and 7B, the vertical axis represents light intensity and the horizontal axis represents positions of the infrared heaters H1 and H2 in the longitudinal direction. The infrared heater H1 (shown by a solid line in FIGS. 7A and 7B) heats a central portion in the longitudinal direction and the infrared heater H2 (shown by dashed lines in FIGS. 7A and 7B) heats both end portions in the longitudinal direction. A sheet of paper is transported so that the center of the sheet of paper in the width direction passes through the center in the longitudinal direction of the infrared heaters regardless of the size of the sheet of paper. In such a fixing device, for example, when a sheet of paper whose width is small is transported, only the infrared heater H1 is turned on and the infrared heater H2 is not turned on. On the other hand, when a sheet of paper whose width is large is transported, both the infrared heaters H1 and H2 are turned on.

In such a fixing device, when the temperature detection sensitivity of the thermostat 14 is not so high, as shown in FIG. 7B, it is required to provide thermostats 14*a* and 14*b* in heating areas of the infrared heaters H1 and H2, respectively. On the other hand, when the thermostat 14 whose temperature detection sensitivity is high is used, as shown in FIG. 7A, the thermostat 14 only has to be provided at a position corresponding to a boundary portion where the light distributions of the infrared heaters H1 and H2 are overlapped and even when any of the infrared heaters H1 and H2 thermally runs away, it is possible to detect the thermal runaway. Even in a fixing device including three or more infrared heaters, in the same manner, the thermostat 14 only has to be provided at a position corresponding to a boundary portion where the light distributions of the infrared heaters are overlapped.

(Seventh Embodiment)

Figure 8:
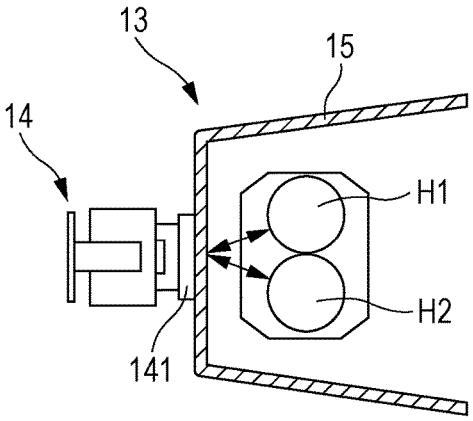
FIG. 8 is a schematic diagram showing a seventh embodiment of the fixing device according to the present invention.

FIG. 8 shows a seventh embodiment of the fixing device according to the present invention. The fixing roller 11 and the pressure roller 12 are the same as those of the first embodiment, so that the description thereof will be omitted and components different from those of the first embodiment will be described.

In the fixing device shown in FIG. 8, the infrared heaters H1 and H2 are arranged in parallel and side by side in the vertical direction. The temperature detection unit 141 of the thermostat 14 is provided on a side plate of the reflection member 15, the distances from which to the two infrared heaters H1 and H2 are substantially the same. In this way, the temperature detection unit 141 is provided at a position, the distances from which to the infrared heaters H1 and H2 are substantially the same, so that even when any of the infrared heaters H1 and H2 thermally runs away, it is possible to detect the thermal runaway. Even in a fixing device including three or more infrared heaters, in the same manner, the temperature detection unit 141 only has to be provided at a position, the distances from which to these infrared heaters are substantially the same.

(Eighth Embodiment)

Even in a normal time when the infrared heaters H1 and H2 do not thermally run away, when a large number of sheets of paper are continuously transported, a turn-on ratio of the infrared heaters H1 and H2 becomes high, so that there is a risk that a detected temperature of the thermostat 14 exceeds a predetermined setting temperature and the power supply to the infrared heaters H1 and H2 is shut down. A countermeasure to such a problem will be described in the following embodiment.

Figure 9B:
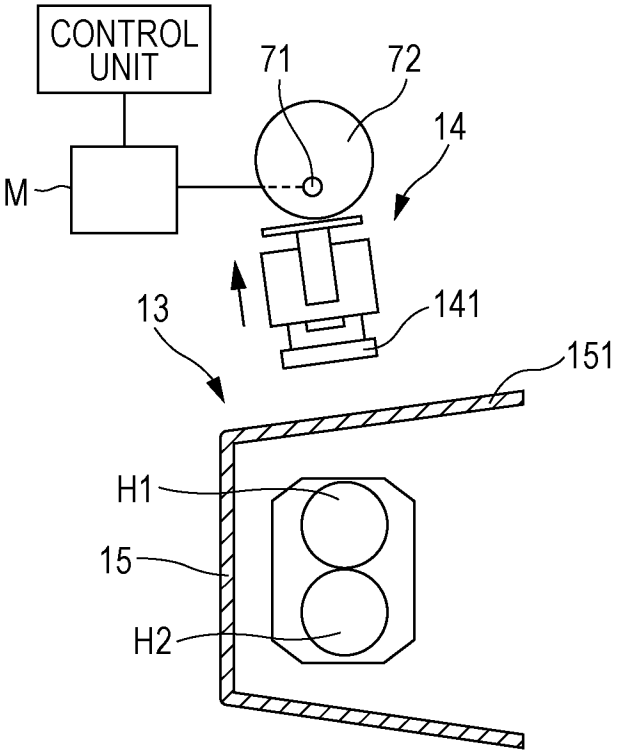
FIGS. 9A and 9B are schematic diagrams showing an eighth embodiment of the fixing device according to the present invention.
Figure 9A:
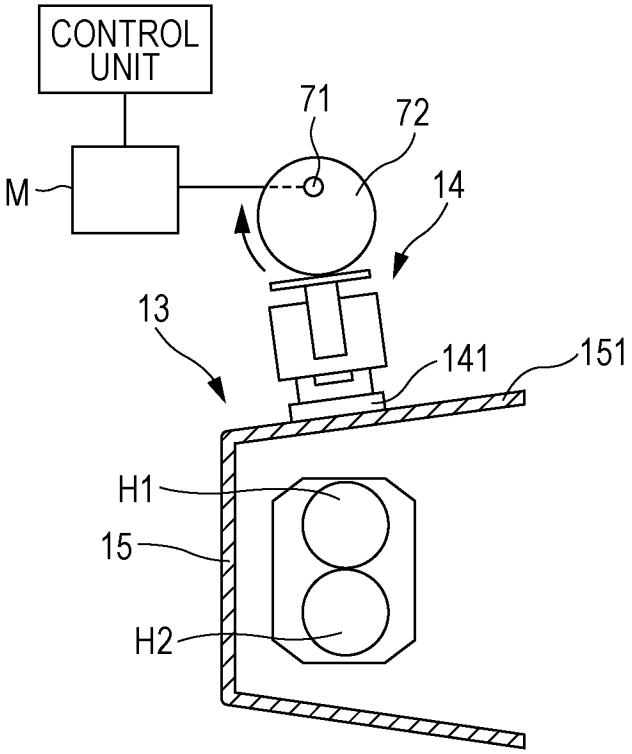

FIGS. 9A and 9B show an eighth embodiment of the fixing device according to the present invention. The fixing roller 11 and the pressure roller 12 are the same as those of the first embodiment, so that the description thereof will be omitted and components different from those of the first embodiment will be described.

In the fixing device shown in FIGS. 9A and 9B, the thermostat 14 can be moved to a temperature detection position where the temperature can be detected and a retreat position where the temperature cannot be detected. When sheets of paper are continuously transported, the thermostat 14 is moved to the retreat position, so that even when a surface temperature of the reflection member 15 exceeds a setting temperature, the power supply to the infrared heaters H1 and H2 is not shut down.

A moving mechanism of the thermostat 14 will be described. The thermostat 14 is constantly urged in a direction in which the thermostat 14 is moved away from the reflection member 15 by an urging section not shown in the drawings. A cam 72 that can rotate around a shaft 71 is in contact with a part of the thermostat 14. The rotation of the cam 72 is performed by rotation control of a motor M by a control unit. The shaft 71 is located eccentrically from the center of the cam 72, so that when a contact point between the thermostat 14 and the cam 72 is farthest from the shaft 71, the temperature detection unit 141 of the thermostat 14 is located at the temperature detection position where the temperature detection unit 141 comes into contact with the reflection member 15 against an urging force of the urging section (FIG. 9A). Next, when the cam 72 rotates and the contact point between the thermostat 14 and the cam 72 becomes closest to the shaft 71, the temperature detection unit 141 of the thermostat 14 is located at the retreat position where the temperature detection unit 141 and the reflection member 15 are farthest from each other (FIG. 9B).

Movement control of the thermostat 14 between the temperature detection position and the retreat position is performed by the control unit. Specifically, for example, when a large number of continuous image forming instruction signals are input, after a predetermined period of time elapses, the control unit outputs a signal for moving the thermostat 14 from the temperature detection position to the retreat position to cause the motor M to rotate. When an image forming end signal is input, after a predetermined period of time elapses, the control unit outputs a signal for moving the thermostat 14 from the retreat position to the temperature detection position to cause the motor M to rotate.

According to the fixing device having such a configuration, even when a large number of sheets of paper are continuously transported, a detected temperature of the thermostat 14 does not exceed a predetermined setting temperature and there is no risk that the power supply to the infrared heaters is shut down.

The present invention also includes a case in which the temperature detection unit 141 of the thermostat 14 is not in contact with the reflection member at the temperature detection position.

(Ninth Embodiment)

Figure 10B:
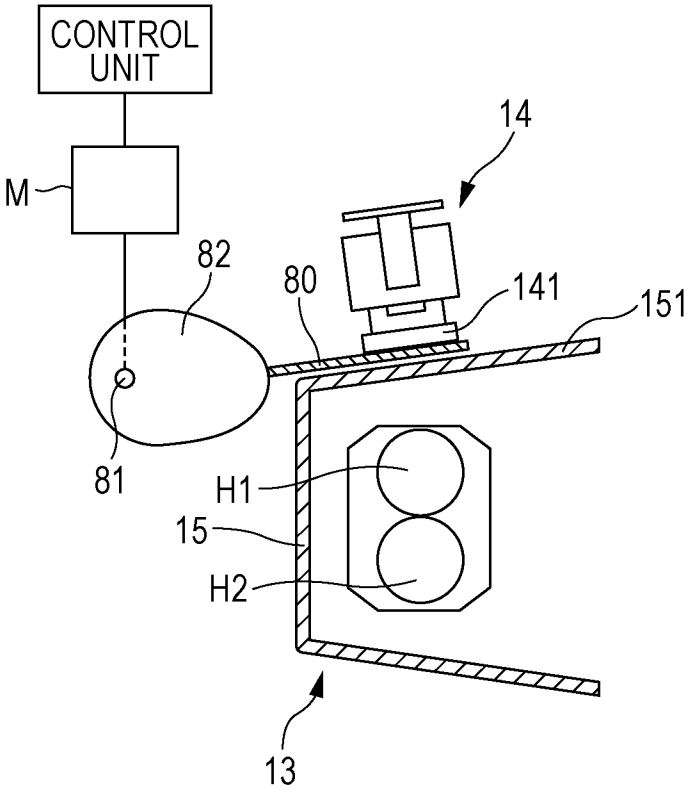
FIGS. 10A and 10B are schematic diagrams showing a ninth embodiment of the fixing device according to the present invention.
Figure 10A:
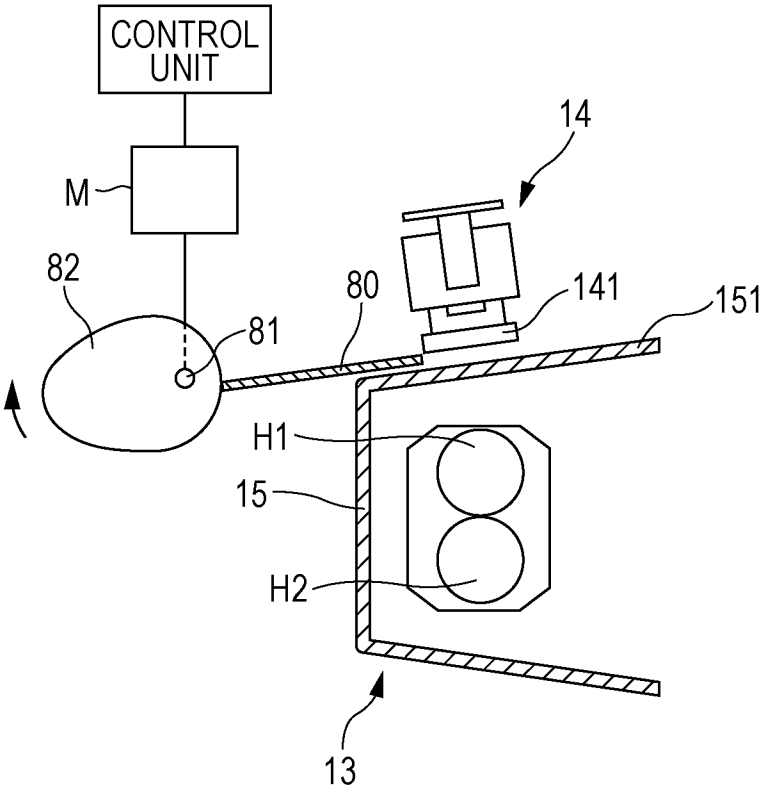

In the fixing device shown in FIGS. 10A and 10B, the temperature detection unit 141 of the thermostat 14 is fixed to a position separate from the reflection member 15 and a plate-shaped heat insulating member (heat insulating section) 80 is removably provided into a gap between the temperature detection unit 141 and the reflection member 15. Specifically, the heat insulating member 80 is constantly urged by an urging section not shown in the drawings in a direction away from the gap between the temperature detection unit 141 and the reflection member 15. A cam 82 rotatable around a shaft 81 is in contact with an end portion of the heat insulating member 80 on the opposite side to the gap. The rotation of the cam 82 is performed by rotation control of a motor M by a control unit. The shaft 81 is located eccentrically from the center of the cam 82, so that when a contact point between the heat insulating member 80 and the cam 82 is closest to the shaft 81, the heat insulating member 80 is located in a position retreated from the gap and the temperature can be detected by the thermostat 14 (FIG. 10A). Next, when the cam. 82 rotates around the shaft 81 and the contact point between the heat insulating member 80 and the cam 82 becomes farthest from the shaft 81 against an urging force of the urging section, the heat insulating member 80 is inserted into the gap and located at a position where the heat from the reflection member 15 to the temperature detection unit 141 is blocked (FIG. 10B). Movement control of the heat insulating member 80 between the retreat position and the blocking position is performed by the control unit. While the control unit acquires information indicating that a sheet of paper is being transported, the control unit sets the heat insulating member 80 to the blocking position.

Also according to such a configuration, even when a large number of sheets of paper are continuously transported, a detected temperature of the thermostat 14 does not exceed a predetermined setting temperature and there is no risk that the power supply to the infrared heaters H1 and H2 is shut down.

(Tenth Embodiment)

Figure 11:
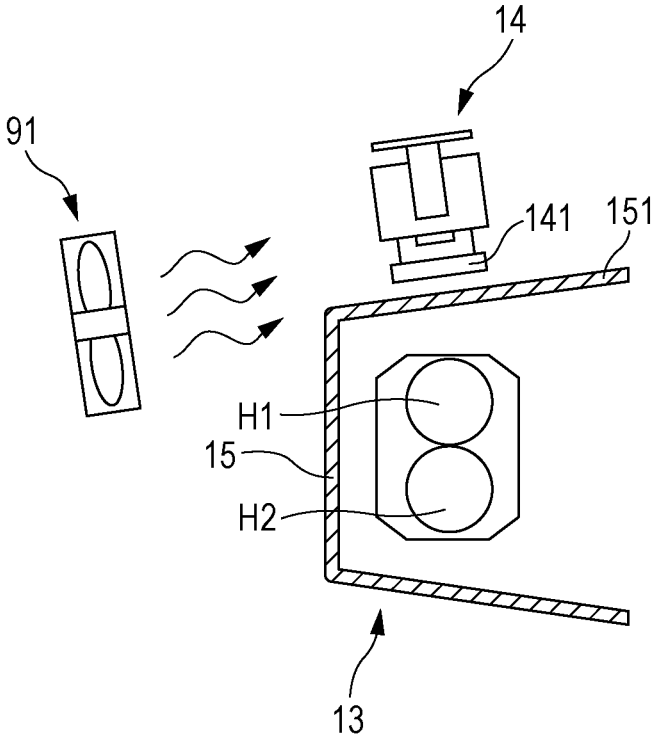
FIG. 11 is a schematic diagram showing a tenth embodiment of the fixing device according to the present invention.

In the fixing device shown in FIG. 11, the temperature detection unit 141 of the thermostat 14 is fixed to a position separate from the reflection member 15 and air is flown through a gap between the temperature detection unit 141 and the reflection member 15 by an air blowing fan (air blowing section) 91. The control unit performs on/off control of the air blowing fan 91 in the same manner as in the eighth and the ninth embodiments. While the control unit acquires information indicating that a sheet of paper is being transported, the control unit drives the air blowing fan 91 to flow air through the gap. Thereby, even when a large number of sheets of paper are continuously transported, a detected temperature of the thermostat 14 does not exceed a predetermined setting temperature and there is no risk that the power supply to the infrared heaters H1 and H2 is shut down. Even when the temperature detection unit 141 of the thermostat 14 and the reflection member 15 are in contact with each other, the configuration of the present embodiment can be applied.

The problem prevention measures described above where the power supply to the infrared heaters H1 and H2 is shut down when a large number of sheets of paper are continuously transported are mechanical measures. However, the problem described above may be prevented by heating control performed by the control unit.

For example, a first setting temperature and a second setting temperature higher than the first setting temperature are provided as setting temperatures at which the power supply to the infrared heaters H1 and H2 is shut down, and the first setting temperature is used when no sheet of paper is transported and the second setting temperature is used while a sheet of paper is being transported. The setting temperature at which the power supply to the infrared heaters H1 and H2 is shut down is changed in this way, so that when a large number of sheets of paper are continuously transported, the possibility that the detected temperature of the thermostat 14 exceeds the second setting temperature is low, so that there is no risk that the power supply to the infrared heaters H1 and H2 is shut down.

In all the embodiments described above, the thermostat 14 in which the temperature detection unit 141 and the power shutdown unit are integrally formed together is used as the power shutdown section. However, it is possible that the temperature detection unit 141 and the power shutdown unit are separated from each other, a detection temperature signal detected by the temperature detection unit 141 is transmitted to the power shutdown unit, and a control unit in the power shutdown unit controls the power supply to the infrared heaters H1 and H2.

Further, in all the embodiments described above, the fixing roller 11 and the pressure roller 12 are a roller mechanism of a pair of rollers. However, a conventionally known mechanism such as a mechanism that uses endless belts as a fixing rotator and a pressure rotator may be used. Further, an image forming device to which the fixing device of the present invention can be applied may be any of a monochrome or color copier, a printer, a facsimile, and a multifunction machine including a plurality of functions of these machines.

According to the fixing device of an embodiment of the present invention, even an external heating type fixing device is useful and can surely and quickly shut down the power supply to the infrared heater and can prevent the fixing rotator from fuming and firing regardless of the state of rotation or stop of the fixing rotator when the infrared heater thermally runs away.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A fixing device comprising:

a fixing rotator;

a pressure rotator configured to be pressed into contact with the fixing rotator to form a nip portion;

a heating section configured to be provided over an outer circumference of the fixing rotator in a non-contact manner with the fixing rotator and heat the fixing rotator; and a power shutdown section configured to shut down power supply to the heating section when temperature becomes higher than a predetermined setting temperature, wherein the heating section includes an infrared heater and a reflection member which covers the infrared heater and whose portion facing the fixing rotator is an opening portion, a longitudinal length of the reflection member is longer than a length in an axis direction of a light emitting unit of the infrared heater, and a temperature detection unit of the power shutdown section is arranged outside the reflection member and at a position on a surface of the reflection member that is away from a terminal edge of the reflection member that is closest to the fixing rotator and not below a vertical position defined by the nip portion;

wherein the reflection member is formed from planer portions and a portion of the temperature detection unit contacting a planar portion of the reflection member is arranged entirely in contact with the planer portion of the reflection member;

wherein an area of an inside surface of the reflection member, which faces the temperature detection unit, is processed to have an emissivity higher than that of the other area of the inside surface.

2. The fixing device according to claim 1, wherein the temperature detection unit is arranged vertically above the infrared heater.

3. The fixing device according to claim 1, wherein a thickness of an area of the reflection member, which faces the temperature detection unit, is thinner than the other area of the reflection member.

4. The fixing device according to claim 3, wherein a shape of an outside surface area of the reflection member, which faces the temperature detection unit, is a recessed shape, and an inside surface area opposite to the recessed shape forms the same shape as that of other inside surface areas of the reflection member.

5. The fixing device according to claim 1, wherein a through hole is formed in an area of the reflection member, which faces the temperature detection unit.

6. The fixing device according to claim 5, wherein a size of the through hole is smaller than the temperature detection unit and light from the infrared heater does not leak to outside from the reflection member through the through hole.

7. The fixing device according to claim 1, wherein when the reflection member becomes an overheated state by the infrared heater, the reflection member deforms so that the temperature detection unit comes close to the infrared heater.

8. The fixing device according to claim 1, wherein the temperature detection unit is movable to a temperature detection position where temperature can be detected and a retreat position where temperature cannot be detected, and the temperature detection unit is located at the retreat position while information indicating that a sheet of paper is being transported is being acquired.

9. The fixing device according to claim 8, further comprising:

a control section configured to control movement of the temperature detection unit, wherein the control section outputs a signal for moving the temperature detection unit from the temperature detection position to the retreat position after a predetermined period of time elapses after an image forming instruction signal is input and outputs a signal for moving the temperature detection unit from the retreat position to the temperature detection position after a predetermined period of time elapses after an image forming end signal is input.

10. The fixing device according to claim 1, further comprising:

a heat insulating section configured to be located between the temperature detection unit and the reflection member and be able to move to a heat blocking position where the heat insulating section blocks heat from the reflection member to the temperature detection unit and a retreat position retreated from between the temperature detection unit and the reflection member, wherein the heat insulating section is located at the heat blocking position while information indicating that a sheet of paper is being transported is being acquired.

11. The fixing device according to claim 1, further comprising:

an air blowing section configured to flow air through a contact portion or a gap portion between the temperature detection unit and the reflection member, wherein the air blowing section flows air through the contact portion or the gap portion between the temperature detection unit and the reflection member while information indicating that a sheet of paper is being transported is being acquired.

12. An image forming device comprising the fixing device according to claim 1.

13. A fixing device comprising:

a fixing rotator;

a pressure rotator configured to be pressed into contact with the fixing rotator to form a nip portion;

a heating section configured to be provided over an outer circumference of the fixing rotator in a non-contact manner with the fixing rotator and heat the fixing rotator; and a power shutdown section configured to shut down power supply to the heating section when temperature becomes higher than a predetermined setting temperature, wherein the heating section includes an infrared heater and a reflection member which covers the infrared heater and whose portion facing the fixing rotator is an opening portion, a longitudinal length of the reflection member is longer than a length in an axis direction of a light emitting unit of the infrared heater, and a temperature detection unit of the power shutdown section is arranged outside the reflection member;

wherein a plurality of infrared heaters are provided so that light distributions in the longitudinal direction are complementary to each other according to a paper width, and the temperature detection unit is provided at a position corresponding to a boundary portion where the light distributions of the plurality of infrared heaters are overlapped.

14. A fixing device comprising:

a fixing rotator;

a pressure rotator configured to be pressed into contact with the fixing rotator to form a nip portion;

a heating section configured to be provided over an outer circumference of the fixing rotator in a non-contact manner with the fixing rotator and heat the fixing rotator; and a power shutdown section configured to shut down power supply to the heating section when temperature becomes higher than a predetermined setting temperature, wherein the heating section includes an infrared heater and a reflection member which covers the infrared heater and whose portion facing the fixing rotator is an opening portion, a longitudinal length of the reflection member is longer than a length in an axis direction of a light emitting unit of the infrared heater, and a temperature detection unit of the power shutdown section is arranged outside the reflection member and at a position on a surface of the reflection member that is away from a terminal edge of the reflection member that is closest to the fixing rotator and not below a vertical position defined by the nip portion;

wherein a plurality of infrared heaters are provided so that light distributions in the longitudinal direction are complementary to each other according to a paper width, and the temperature detection unit is provided at a position, distances from which to each infrared heater are the same.

15. A fixing device comprising:

a fixing rotator;

and a pressure rotator configured to be pressed into contact with the fixing rotator to form a nip portion;

a heating section configured to be provided over an outer circumference of the fixing rotator in a non-contact manner with the fixing rotator and heat the fixing rotator; and a power shutdown section configured to shut down power supply to the heating section when temperature becomes higher than a predetermined setting temperature, wherein the heating section includes an infrared heater and a reflection member which covers the infrared heater and whose portion facing the fixing rotator is an opening portion, a longitudinal length of the reflection member is longer than a length in an axis direction of a light emitting unit of the infrared heater, and a temperature detection unit of the power shutdown section is arranged outside the reflection member;

wherein a first setting temperature and a second setting temperature higher than the first setting temperature are provided as setting temperatures at which the power supply to the heating section is shut down, the first setting temperature is used when no sheet of paper is transported, and the second setting temperature is used while a sheet of paper is being transported.

* * * * *